US007367170B2

(12) United States Patent
Häfker et al.

(10) Patent No.: US 7,367,170 B2
(45) Date of Patent: May 6, 2008

(54) METHOD AND DEVICE FOR TRANSFERRING, IN PARTICULAR, FLAVORING AGENTS TO CIGARETTES

(75) Inventors: Thomas Häfker, Langwedel (DE); Axel Leifheit, Häuslingen (DE); Ralph Sgodzai, Ritterhude (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 0 days.

(21) Appl. No.: 10/596,511

(22) PCT Filed: Dec. 27, 2004

(86) PCT No.: PCT/EP2004/014730

§ 371 (c)(1),
(2), (4) Date: Jun. 15, 2006

(87) PCT Pub. No.: WO2005/065471

PCT Pub. Date: Jul. 21, 2005

(65) Prior Publication Data

US 2007/0102014 A1 May 10, 2007

(30) Foreign Application Priority Data

Dec. 31, 2003 (DE) ..... 103 61 796

(51) Int. Cl.
*B65B 19/22* (2006.01)
*B65B 61/00* (2006.01)

(52) U.S. Cl. ..... 53/234; 53/239

(58) Field of Classification Search ..... 53/239
See application file for complete search history.

(56) References Cited

U.S. PATENT DOCUMENTS

| | | | | |
|---|---|---|---|---|
| 2,333,049 | A * | 10/1943 | Shapiro | 131/300 |
| 3,847,162 | A * | 11/1974 | Seil | 131/300 |
| 4,619,276 | A | 10/1986 | Albertson | |
| 4,751,806 | A * | 6/1988 | Gram | 53/282 |
| 4,966,170 | A * | 10/1990 | Keritsis et al. | 131/88 |
| 6,170,239 | B1 | 1/2001 | Focke et al. | |
| 6,745,778 | B2 * | 6/2004 | Grzonka et al. | 131/309 |

FOREIGN PATENT DOCUMENTS

| | | |
|---|---|---|
| DE | 691 00 703 T2 | 4/1991 |
| DE | 100 52 409 C1 | 11/2001 |

* cited by examiner

*Primary Examiner*—John Sipos
(74) *Attorney, Agent, or Firm*—Sughrue Mion, PLLC

(57) ABSTRACT

(Liquid) flavoring agents and other substances are transferred to cigarettes immediately prior to or during the packaging operation of the cigarettes (12). An advantageous solution is that of the substances being transferred directly to free ends of the cigarettes (12) once cigarette groups (11) have been formed and during transportation of these groups. As an alternative, the substances can be transferred to the inside of an inner wrapper of the cigarette group in particular to a folding tab of a base wall.

7 Claims, 4 Drawing Sheets

17
19
20
15
16
11
43
17
18
44
11
21
VI
VI
22
II
34
28
35
10

METHOD AND DEVICE FOR TRANSFERRING, IN PARTICULAR, FLAVORING AGENTS TO CIGARETTES

The invention relates to a method of transferring liquid substances, in particular flavoring agents, to cigarettes. The invention also relates to an apparatus for implementing the method.

The operation of transferring liquid substances to cigarettes is becoming more and more important. These liquid substances are predominantly flavoring agents, e.g. menthol. However, other substances which reduce those effects of the cigarettes which are damaging to health are also possible.

The object of the invention is to propose measures for transferring in particular flavoring agents to cigarettes which do not adversely affect the production or packaging process and, furthermore, result in the flavoring agents or the like being effective over the long term.

In order to achieve this object, the method according to the invention is characterized in that the substance(s) is/are fed to the cigarettes downstream of a cigarette store, in particular downstream of a cigarette magazine, during the preferably continuous transportation of the cigarette group by a cigarette conveyer with pockets for a respective cigarette group, or during a standstill phase of the cyclically transported cigarette groups.

The invention discloses two basic ways of proceeding: the liquid substance can be transferred by a conveyer, such as a pocket chain or (folding) turret, during transportation of the cigarette group. As an alternative, or in addition, substances can be fed during a first packaging step, to be precise, in particular, by virtue of the substance being transferred to an inner wrapper (inner liner) for the cigarettes.

The apparatus according to the invention is a packaging machine for producing cigarette packs. Cigarette groups, as pack contents, are transported downstream of a cigarette magazine, in particular by a cyclically moving pocket chain. A subassembly for transferring the substance to the cigarette group is positioned (in a stationary manner) in the region of the pocket chain.

As an alternative, a flavoring subassembly is assigned to a turret, namely folding turret, it being possible for the substance to be transferred to the inside of a base tab of an inner wrapper during the folding process of the latter but prior to the folding tab being folded, in particular during the (rotary) movement of the turret.

Figure 1:
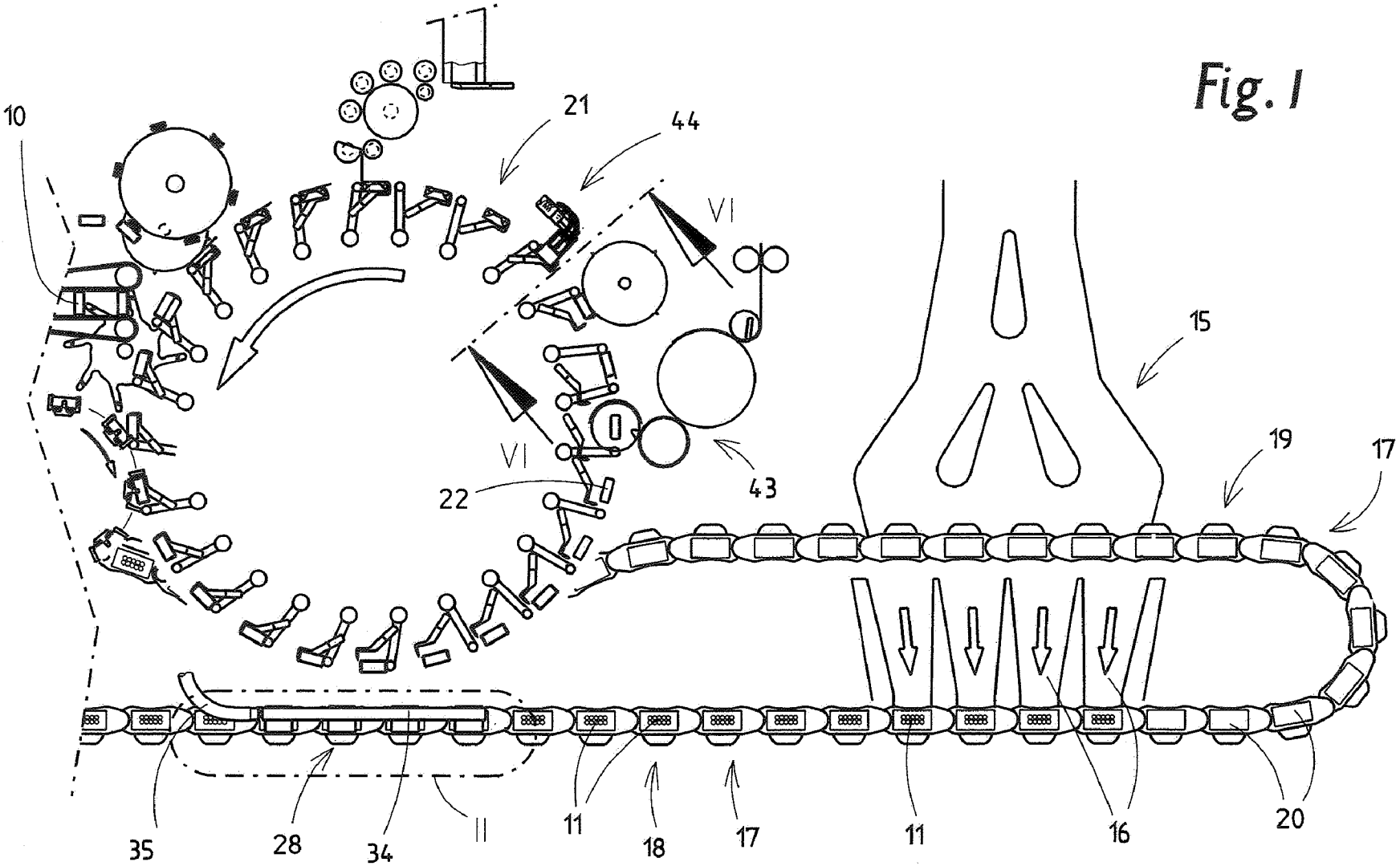
Figures 2, 3:
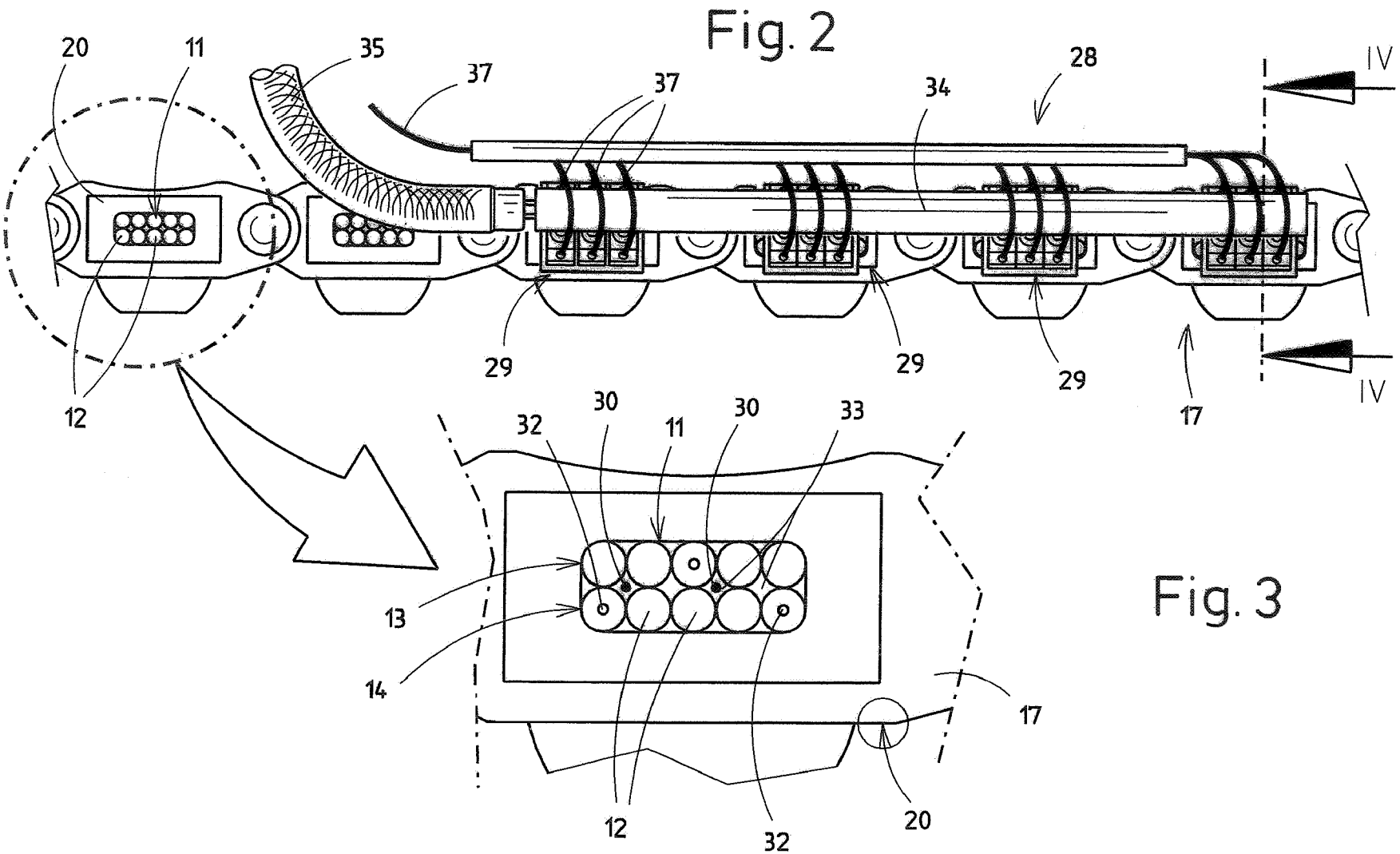
Figure 4:
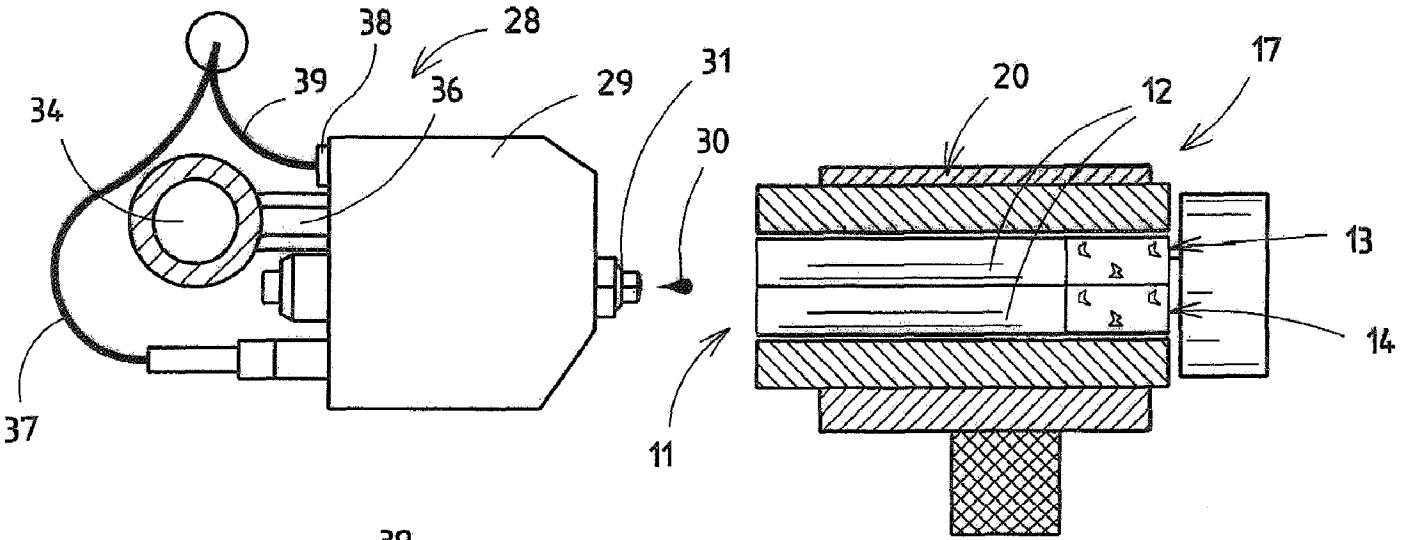
Figure 5:
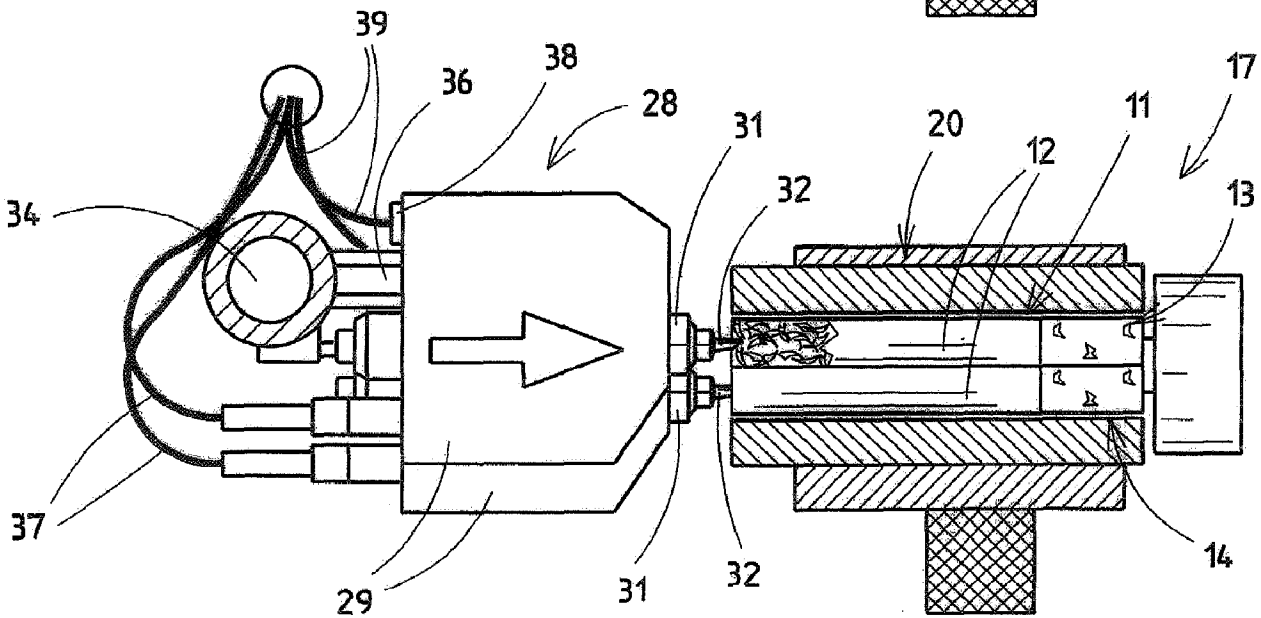
Figure 6:
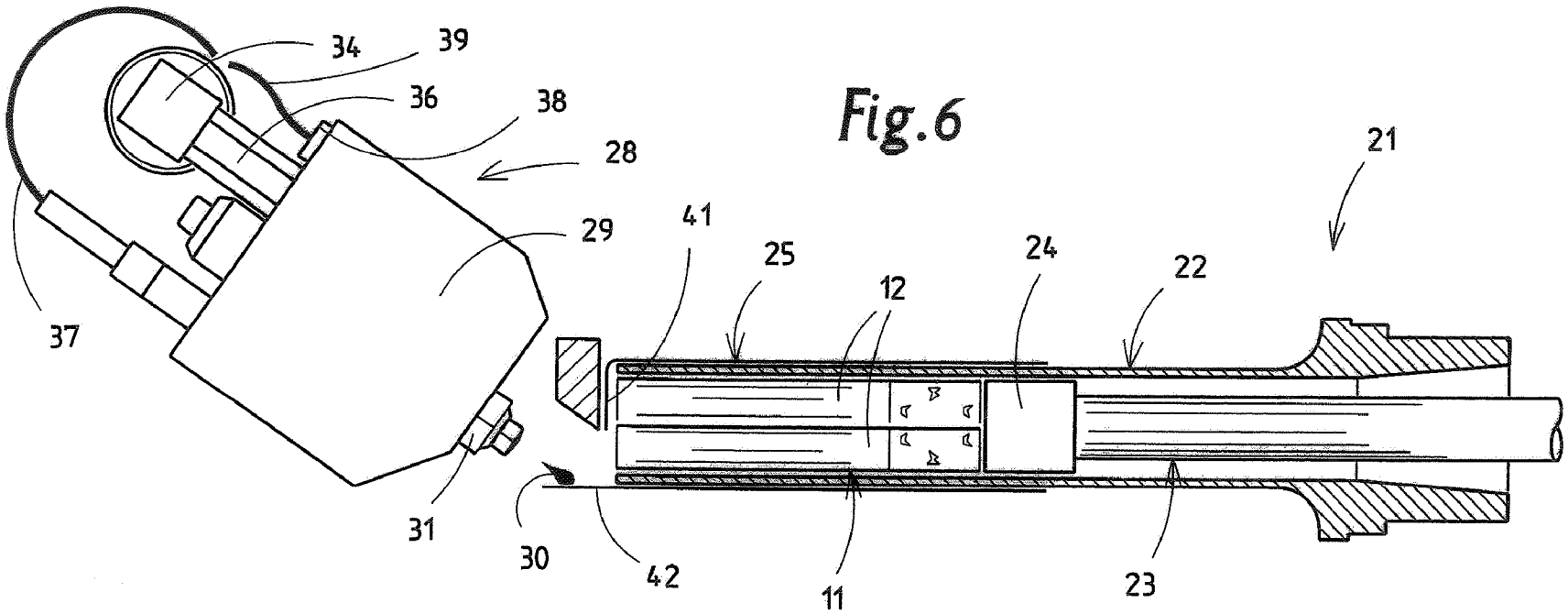
Figure 8:
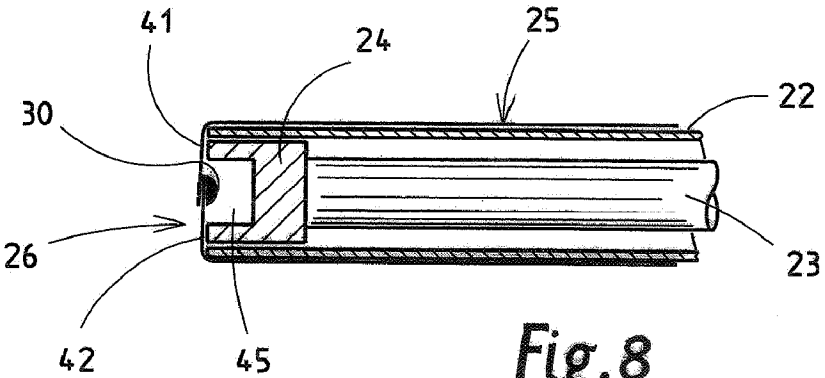
Figure 7:
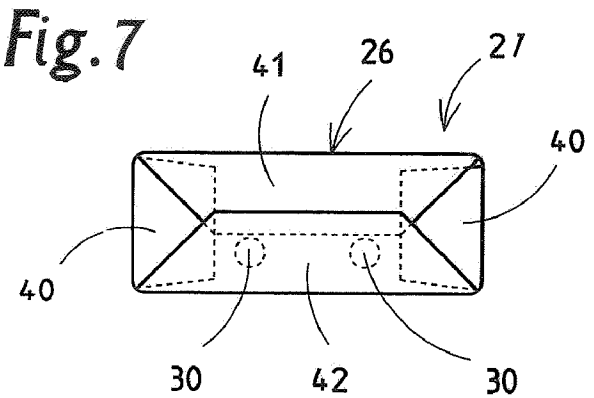

Further details of the invention are explained more specifically hereinbelow with reference to exemplary embodiments. In the figures:

FIG. 1 shows a schematic side view of part of a packaging machine,

FIG. 2 shows, on an enlarged scale, a flavoring subassembly as a detail of FIG. 1, FIG. 3 shows, on a further-enlarged scale, a pocket of a pocket chain according to FIG. 2, FIG. 4 shows, on an enlarged scale, a cross section through the cigarette conveyer according to FIG. 2, along the section plane IV-IV from FIG. 2, FIG. 5 shows an illustration analogous to FIG. 4 for another embodiment, FIG. 6 shows a detail of a flavoring subassembly for a folding turret with an axial section through a folding mandrel, FIG. 7 shows a bottom view of a cigarette pack or of a cigarette group with inner wrapper, and FIG. 8 shows an alternative for positioning a (flavoring) substance in the region of an inner wrapper.

The exemplary embodiments or use examples illustrated concern the production of cigarette packs 10 configured as hard packs of the shell and slide type. Flavoring substances or the like can be provided for hinge-lid boxes, soft carton packs, etc. in an identical or analogous manner.

For producing cigarette packs 10, first of all cigarette groups 11, assigned to a respective cigarette pack 10, are formed. Each comprises a plurality of cigarettes 12, which are arranged in a regular formation to form cigarette rows 13, 14. The cigarette groups 11 may also comprise three or more cigarette rows, to be precise, also with the cigarettes 12 of adjacent cigarette rows being offset relative to one another.

In order to form the cigarette groups 11, the cigarettes 12 are removed from a cigarette magazine 15. The latter has a number of groups of upright shafts in its bottom region. In the case of the exemplary embodiment of FIG. 1, the cigarette magazine 15 is assigned four shaft groups 16, located one beside the other. A complete cigarette group 11 is pushed out of each shaft group 16 at the bottom and into a cigarette conveyer. The latter is designed here as a pocket conveyer, namely as a pocket chain 17. The ways in which such a pocket chain 17 is constructed and operates are known.

The special feature of the pocket chain 17 is that a (bottom) conveying strand 18 is moved cyclically and a return strand 19 is moved continuously. During a standstill phase, the cigarette groups 11 are pushed into respectively adjacent pockets 20 of the pocket chain 17. The pockets 20 are open on both sides, so that free ends of the cigarettes 12 or of filters are not concealed.

The cigarette groups 11 are fed by the pocket chain 17 to a further cigarette conveyer or pack conveyer, namely to a folding turret 21. The latter has, on its circumference, a number of accommodating means or pockets, each for one cigarette group 11. The latter is introduced by axial displacement into an associated accommodating means of the folding turret 21. In the case of the present exemplary embodiment, the accommodating means is designed as a folding mandrel 22, namely as a thin-walled hollow body which is open at both ends. The cigarette group 11 is pushed into the folding mandrel 22 by a push rod 23 with push-rod head 24. A blank of packaging material, to be precise in particular a blank of an inner wrapper 25, is positioned and folded on the outside of the folding mandrel 22. This inner wrapper comprises (coated) paper, tinfoil, film or the like. The cigarette group 11, as pack contents, is completely enclosed by the inner wrapper 25, to be precise with a base wall 26 and a corresponding end wall being formed.

The cigarette group 11 with the folded inner wrapper 25 forms a cigarette block 27 as contents of the cigarette pack 10. Further blanks of the cigarette pack 10 are applied by the folding turret 21 as transportation of the cigarette group 11 or of the cigarette block 27 continues, so that, finally, (largely) finished cigarette packs 10 leave the region of the folding turret 21.

The cigarettes 12 are to be fed (liquid) substances, to be precise in particular flavoring agents. Menthol is a flavoring which is used on a frequent basis. This is liquid above a temperature of 40° C. and can thus be fed as a liquid. The substances are added immediately prior to, or during, the packaging process of the cigarettes. Transfer to the cigarettes 12 is carried out such that certain parts or mechanisms of the packaging machine do not come into contact with the substances.

An advantageous way of proceeding is to feed liquid substances to the cigarette groups 11 to be precise downstream of the cigarette magazine 15, during transportation of the cigarette groups 11. According to FIG. 1, the substance is transferred in the region of the bottom, conveying strand 18 during a standstill phase of the cigarette group 11, to be precise in the region of the free ends of the cigarettes 12, and in the case of filter cigarettes in the region of free tobacco ends (FIGS. 4 and 5).

A transfer mechanism, namely a flavoring subassembly 28, is positioned in a stationary manner in the region of the conveying section of the cigarette groups 11, namely adjacent to the pocket chain 17. The flavoring subassembly 28 comprises a plurality of metering units 29 each assigned to a cigarette group 11 or a pocket 20 of the pocket chain 17. During the standstill phase of the conveying strand 18, the (four) metering units 29 of the flavoring subassembly 28 are aligned opposite a respective cigarette group 11.

A number of alternatives are envisaged for transferring the liquid substance to the cigarette group 11. It is possible for droplet-form portions 30 to be fed to the cigarette group 11, to be precise, in particular, by contactless transfer (FIG. 4). The metering unit 29, in this case, is of nozzle-like design with at least one nozzle head 31. The latter transfers a metered portion 30 of the substance in free flight to the cigarette group 11. The metering unit 29 may also be designed such that a plurality of portions 30 are fed to each cigarette group 11. The metering unit 29 or the nozzle head 31 here is oriented such that the portion 30 comes into contact with the cigarette group 11 approximately in the region of a (horizontal) longitudinal center plane.

As an alternative, it is possible for the substances to be transferred to the cigarette group 11 in a precisely positioned manner. In this case, the metering unit 29 comes into contact with the cigarettes 12 or the cigarette group 11. Each metering unit 29 is provided with at least one introduction tube or hollow introduction needle 32. This is introduced into a cigarette 12 by way of a free end region (FIG. 5). As an alternative, or in addition (other) introduction needles 32 can enter into gaps 33 which are formed within the cigarette group 11 between adjacent cigarettes 12. Optimum distribution of the substance can be achieved by a plurality of introduction needles 32 being distributed over the cross-sectional surface area of a cigarette group 11, the needles introducing substance into selected cigarettes 12 and/or into the gaps 33 (FIG. 3). For the (flavoring) substance to take effect, it is not necessary for each cigarette 12 and/or each gap 33 to be supplied with a portion 30. Metering units 29 are advantageously with two or three introduction needles 32 or nozzle heads 31.

In the case of this configuration (FIG. 5) the flavoring subassembly 28 is arranged in a transversely movable manner, that is to say it is moved up to the cigarette groups 11 during the standstill phase of the pocket chain 17 such that the correspondingly positioned introduction needles 32 enter into the region of the cigarette group 11.

The flavoring subassembly 28, which is suitable in particular for feeding menthol, has an elongate (horizontal) distributor tube 34. The liquid substance that is to say menthol heated in particular to approximately 41° C. is fed in this distributor tube. A (heated) feed line 35 follows one end of the distributor tube 34. The distributor tube 34 is connected to each metering unit 29 via connecting tubes 36. These are provided with electrically controllable valves, to be precise for each nozzle head 31 and/or for each introduction needle 32. The valves can be controlled electrically via corresponding lines 37 which lead to the valves within the metering unit 29. Furthermore, (electric) heating mechanisms or heating cartridges 38 are arranged within the metering unit 29, and are likewise connected to electric heating lines 39. The temperature in the region of the nozzle unit can be set precisely by sensors.

The substance can also be fed or applied during a (continuous) conveying movement of the cigarette group 11. FIGS. 6 to 8 relate to the application of a liquid substance to the inner wrapper 25 for the cigarette group 11. The substance or a portion 30 of the same is applied to the inside of the inner wrapper 25. Applying the substance to the inside of the base wall 26 is particularly effective. This base wall comprises a plurality of folding tabs, namely side tabs 40 and longitudinal tabs 41, 42. According to FIG. 6, the portion 30 is applied to a longitudinal tab 42 which is last to be folded, that is to say is on the outside. Prior to the folding process, this longitudinal tab is directed in a plane parallel to the longitudinal extent of the cigarettes 12. An inner side of the folding tab or the longitudinal tab 42 is directed upward. By means of the obliquely directed flavoring subassembly 28 or of the obliquely directed metering unit 29, the portion 30 is applied, during the conveying movement of the inner wrapper 25 to the longitudinal tab 42, which is directed transversely to the plane of the base wall 26. The longitudinal tab 42 is then folded into the position which is shown in FIG. 7. As can be seen, the metering unit 29 or the nozzle head 31 thereof is actuated such that a plurality of (two) portions 30 are applied one after the other, to be precise outside the region of overlap with other folding tabs, in particular outside the region covered over by the longitudinal tab 41, which was the first to be folded. The portions 30 thus come into direct contact with the free end sides of the cigarettes 12.

Application of the substance according to FIGS. 6 and 7 takes place in the region of the folding turret 21. The latter is assigned a first blank station 43 for transferring a blank for the inner wrapper 25 to a folding mandrel 22. The cigarette group 11, which is fed by the pocket chain 17, is located within the folding mandrel 22. The inner wrapper 25 is partially folded on the folding mandrel 22. A flavoring station 44 follows. In the region of the latter, at least one transfer mechanism 28 or a metering unit 29 configured according to FIG. 6 is positioned such that it is possible for the portion 30 to be transferred to the radially inner longitudinal tab 42 or the free inner side thereof.

FIG. 8 shows a further alternative. In the case of this example—as is conventional in the production of soft-carton packs—first of all the base wall 26 of the inner wrapper 25 is folded, that is to say prior to the cigarette group 11 being introduced into the folding mandrel 22. The push rod 23 or its head 24 forms a support during the operation of folding the base wall 26. As has been said, at least one portion 30 of the flavoring agent is applied to the inside of the base wall 26. In order that this substance is not transferred to the push-rod head 24, a recess 45 is formed in the push-rod head 24 in the region of the one or more portions 30.

The way in which the rest of the production process with the cigarette pack proceeds may correspond to the prior art.

The operation of feeding (liquid) substances, in particular flavoring agents, to the cigarettes 12 takes place exclusively once the cigarette groups 11 have been formed. As a further alternative, it is possible, once a cigarette block comprising the cigarette group 11 with inner wrapper 25 has been completed, to feed the substance by means of a thin injection needle which penetrates the inner wrapper 25.

The flavoring substance is effective even if not every cigarette is in direct contact with the substance. The flavoring is distributed amongst all the cigarettes within the closed pack and/or is effective for all the cigarettes. The substance may also be sprayed onto the cigarettes or cigarette ends.

LIST OF DESIGNATIONS

10 Cigarette pack
11 Cigarette group
12 Cigarettes
13 Cigarette row
14 Cigarette row
15 Cigarette magazine
16 Shaft group
17 Pocket chain
18 Conveying strand
19 Return strand
20 Pocket
21 Folding turret
22 Folding mandrel
23 Push rod
24 Push-rod head
25 Inner wrapper
26 Base wall
27 Cigarette block
28 Flavoring subassembly
29 Metering unit
30 Portion
31 Nozzle head
32 Introduction needle
33 Gap
34 Distributor tube
35 Feed line
36 Connecting tube
37 Line
38 Heating cartridge
39 Heating line
40 Side tab
41 Longitudinal tab
42 Longitudinal tab
43 Blank station
44 Flavoring station
45 Recess

The invention claimed is:

1. An apparatus for transferring liquid substances to cigarettes (12) of a cigarette group (11), corresponding to the contents of a cigarette pack (10), comprising:

a) an endless cigarette conveyer with pockets (20) for transporting respective cigarette groups, the cigarettes (12) of the cigarette groups (11) being arranged in the pockets (20) transversely to the conveying direction such that free end surfaces of the cigarettes (12) are directed sideways, and b) at least one stationary or movable flavoring subassembly (28) comprising at least one metering unit (29)for transferring the substance(s) to at least one cigarette group (11) as the positions of the metering unit (29) and cigarette group (11) relative to one another momentarily coincide;

c) said flavoring subassembly comprising an introduction needle (32) arranged so that it is introduced into a gap (33) formed between adjacent cigarettes (12) of a cigarette group (11) for transferring a determinable quantity of substance to individual gaps (33) for the operation of feeding the substance.

2. The apparatus as claimed in claim 1, characterized in that, with the cigarette conveyer being driven cyclically, with a cyclically moving conveying strand (18), said stationary flavoring subassembly (28) is arranged alongside the moving path of the cigarette conveyer such that during the standstill of the cigarette conveyer, one or more metering units (29) arranged one beside the other is/are positioned opposite a respective cigarette group (11) opposite the filter-free ends of the cigarettes (12), and such that, during the standstill, substance can be transferred from the metering unit (29) to the adjacent cigarette group (11).

3. The apparatus as claimed in claim 2, characterized in that said conveyor comprises a pocket chain (17) which is moved cyclically by the distance of four pockets (20) in each case, the flavoring subassembly (28) has four metering units (29) located one beside the other in accordance with the spacing between the pockets (20).

4. An apparatus for transferring liquid substances to cigarettes (12) of a cigarette group (11), corresponding to the contents of a cigarette pack (10), comprising:

a) a packaging folding turret for packing the group of cigarettes in an inner wrapper (25) having folding tabs (42), b) a fixed or movable flavouring subassembly (28) which has at least one metering unit (29) for transferring a flavouring substance to the inside surface of at least one folding tab (42) of the inner wrapper (25) during a momentary standstill or during the conveying movement of the folding turret, and c) a folding mechanism for folding the tab against the cigarettes so that the flavouring substance on the tab is exposed to the cigarettes within the package.

5. The apparatus as claimed in claims, claim 4, characterized in that the substance or a portion thereof (30) is transferred to the inside of an exposed folding tab of the inner wrapper (25) prior to the folding tab being folded.

6. The apparatus as claimed in claim 4, characterized in that the substance is transferred by the metering unit (29), having a nozzle head which is positioned in a stationary manner alongside the movement path of the inner wrapper (25), as the inner wrapper (25), is transported by said folding turret (21), the metering unit (29) or nozzle head (31) for discharging a portion of said substance (30) being directed obliquely, or at an angle, in relation to the folding tab.

7. The apparatus as claimed in claim 5, characterized in that a plurality of portions (30) which follow one after another in the conveying direction is transferred to the folding tab.

* * * * *